United States Patent [19]

Hashimoto et al.

[11] Patent Number: 4,884,894

[45] Date of Patent: Dec. 5, 1989

[54] FLUID MIXING ELEMENT

[75] Inventors: Nobuo Hashimoto; Hideo Ishii; Kenji Tanahashi; Kenji Ohno; Kiichi Ohno, all of Tokyo, Japan

[73] Assignee: Yuugenkaisha Ohnobankinkougyousho, Tokyo, Japan

[21] Appl. No.: 311,369

[22] Filed: Feb. 14, 1989

Related U.S. Application Data

[63] Continuation of Ser. No. 890,914, Jul. 28, 1986, abandoned.

[30] Foreign Application Priority Data

Aug. 14, 1985 [JP] Japan ..... 60-177656

[51] Int. Cl.[4] ..... B01F 5/00

[52] U.S. Cl. ..... 366/338

[58] Field of Search ..... 366/336, 338, 339, 340, 366/174; 138/42, 44, 111, 114; 48/180.1, 189.4, 189.5

[56] References Cited

U.S. PATENT DOCUMENTS

| | | | |
|---|---|---|---|
| 1,496,345 | 6/1924 | Lichtenthaler | 366/339 X |
| 2,784,948 | 3/1957 | Pahl et al. | 366/339 X |
| 3,860,217 | 1/1975 | Grout | 366/336 |
| 4,111,402 | 9/1978 | Barbini | 366/338 |
| 4,522,504 | 6/1985 | Greverath | 366/338 X |

FOREIGN PATENT DOCUMENTS

| | | | |
|---|---|---|---|
| 0084180 | 7/1983 | European Pat. Off. | 366/339 |
| 729226 | 5/1955 | United Kingdom | 336/339 |

*Primary Examiner*—Harvey C. Hornsby
*Assistant Examiner*—Scott J. Haugland
*Attorney, Agent, or Firm*—Burgess, Ryan & Wayne

[57] ABSTRACT

Diclosed are a fluid mixing element in which at least one helical shaft provided with at least one helical groove on an outer peripheral wall thereof throughtout its length is inserted in a cylindrical passage tube provided with at least one helical groove on an inner peripheral wall thereof throughout its length.

According to the mixing element of the present invention, the fluid supplied into the mixing element flows partly along the helical groove formed in the passage tube and partly along the helical groove formed on the helical shaft to produce the turbulent mixing of the fluid in the mixing element. When the fluid flows through the helical grooves formed in the passage tube and on the helical shaft of the mixing element, the phase transfer is also carried out at planes perpendicular to the flow direction by inertia of the fluid. Accordingly, the fluid in contact with the helical grooves and the fluid out of contact therewith are replaced with each other in series. The mixing is further effected by division of the fluid in series at each of many contact portions of the passage tube and the helical shaft.

As a result, the fluid mixing efficiency can be improved. The number of the mixing elements is therefore reduciable, when the plural mixing elements are connected to each other to form the mixer, and in addition, the time required for mixing in the mixer is also reducible.

13 Claims, 10 Drawing Sheets

FLUID MIXING ELEMENT

This application is a continuation, of application Ser. No. 890,914, filed 7/28/86, now abandoned.

BACKGROUND OF THE INVENTION

1. Technical Field

The present invention relates to a fluid mixing element which is employed for a static mixer for mixing two or more fluids in the same phase or in different pahses, namely gases, solids (powders or granules) and the like.

2. Background of the Invention

As mixing devices for mixing different kinds of fluids in the same phase or in different phases, various static mixers for mixing the fluids by virtue of their kinetic energies without any other power source have conventionally been proposed.

For example, U.S. Pat. No. 3,286,992 describes such a mixer, which is shown in FIGS. 22 to 24. The Mixer 19 comprises an elongated cylindrical passage tube 17 and short helical blades 18 arranged alternately and in point-contact with each other in the passage tube 17, the contacting edges of each blade 18 being positioned at an angle to those of the adjacent blades.

In such a mixer 19, fluid passages 17*a* formed in the passage tube 17 are formed in such a manner that fluids A and B which flow through the fluid passages 17*a*, respectivley, are introduced into the fluid passages 17a of the subsequent blade 18 in the condition that the fluids A and B are divided and mixed by the discontinuous axial displacement of the fluid passages 17*a* between the blades 18.

However, in the mixer 19 described above, the blades 18 are connected to each other at their contacting edges by welding or brazing. Accordingly, the fluids may stagnate at the junctions.

Further, the fluids A and B are helically rotated so as to follow the profile of the twisted blade 18 described above, because of its helical configuration, and thereby the eddy flow motion of the fluids is caused in each fluid passage 17*a*. Some degree of turbulent mixing is consequently induced in the passage.

In order to mix the fluids more effectively by utilizing this motion, it is preferable to use the blade 18 twisted at a wider angle. However, special equipment is required, for example, for welding the passage tube 17 and the blades 18 twisted at an angle of 180 degrees as shown in FIGS. 22 to 24.

Next, As an example of techniques for preventing the abnormal stagnation of the fluids which occurs at the junction of the blades previously described, U.S. Pat. No. 4,466,741 describes a mixing element 22 comprising a short passage tube 20 and a helical blade 21 formed in the passage tube 20 so as to be integral therewith as shown in FIGS. 25 to 27. The mixing elements 22 are arranged in a suitable number to be used in such a manner that the contacting edges of the adjacent blades 21 cross at a prescribed angle with the axial displacement as shown in FIG. 27.

In the mixing element 22, fluids A and B are fed into a fluid passage 20*a* and mixed with each other mainly by virtue of dividing and mixing of the fluids in a similar manner as the invention described in U.S. Pat. No. 3,286,992 stated above.

However, when the mixing element in which the blade is formed integrally with the passage tube is manufactured as shown in U.S. Pat. No. 4,466,741 described above, it is technically difficult to form the element having the blade twisted at an angle of at least 90 degrees by casting or injection molding.

Particularly, it is extremely difficult to form the blade twisted at a wider angle in the passage tube so as to be integral therewith, as shown in FIGS. 22 to 24 described in U.S. Pat. No. 3,286,992.

Further, the dividing mixing which is a main mixing form achieved by the mixing element described in U.S. Pat. No. 3,286,992 or 4,466,741 is inferior in the mixing efficiency. For obtaining the uniform mixture of the fluids finally, therfore, a larger number of mixing elements are required to be connected to each other for use.

SUMMARY OF THE INVENTION

The present invention is completed against the background of these conventional technical subjects.

An object of the present invention is to provide a fluid mixing element in which a structure twisted at an angle of at least 90 degrees is formed in a passage tube and which can be easily manufactured.

Another object of the present invention is to provide a fluid mixing element which is excellent in the fluid mixing efficiency, therefore the number of the mixing elements being reducible, when the plural mixing elements are connected to each other to form a mixer.

Still another object of the present invention is to provide a fluid mixing element also reducible in the mixing time when used as a mixer.

Other objects and advantages of the present invention will be apparent from the following description.

In accordance with the present invention, there is provided a fluid mixing element (hereinafter sometimes referred to as "mixing element" for brevity) comprising a cylindrical passage tube provided with at least one helical groove on an inner peripheral wall of said passage tube throughout its length, and at least one helical shaft provided with at least one helical groove on an outer peripheral wall of said helical shaft throughout its length, said cylindrical passage tube having said helical shaft insserted therein.

BRIEF DESCRIPTION OF THE DRAWINGS

FIGS. 1 to 14 show embodiments of the present invention; in which

FIG. 1 is an elevational view showing a mixing element of the present invention;

FIG. 2 is a sectional perspective view taken along line I—I of FIG. 1;

FIG. 3 is an elevational view showing a passage tube with a helical groove formed so as to rotate clockwise, which constitutes the mixing element of the present invention;

FIG. 4 is a sectional view taken along line II—II of FIG. 3;

FIG. 5 is an elevational view showing a helical shaft with a helical groove formed so as to rotate counterclockwise, which constitutes the mixing element of the present invention;

FIG. 6 is a side view of the helical shaft shown in FIG. 5;

FIG. 7 is an elevational view showing a mixing element of the present invention;

FIG. 8 is a sectional perspective view taken along line III—III of FIG. 7;

FIG. 9 is an elevational view showing a passage tube with a helical groove formed so as to rotate counterclockwise which constitutes the mixing element of the present invention;

FIG. 10 is a sectional view taken along line IV—IV of FIG. 9;

FIG. 11 is an elevational view showing a helical shaft with a helical groove formed so as to rotate clockwise, which constitutes the mixing element of the present invention;

FIG. 12 is a side view of the helical shaft shown in FIG. 11;

FIG. 13 is a longitudinal sectional view showing a center part of a mixer assembled by connecting the mixing elements according to the present invention; and FIG. 14 is a graph indicating the relation between "the mixing efficiency and the number of the connected mixing elements", for the mixer 7 constituted by the mixing elements of the present invention and the conventional mixers shown in FIGS. 24 and 27;

FIGS. 15 to 17 show other embodiments of the present invention; in which

FIG. 15 is a sectional perspective view showing a mixing element formed in such a manner that a fluid passage of the mixing element shown in FIG. 2 is gradually decreased in its cross-sectional area in the flowing direction of the fluid;

FIG. 16 is a sectional perspective view showing a mixing element formed in such a manner that a fluid passage of the mixing element shown in FIG. 8 is gradually decreased in its cross-sectional area in the flowing direction of the fluid; and FIG. 17 is a longitudinal sectional view showing a central part of a mixer assembled by connecting the mixing elements shown in FIG. 15 and 16;

FIGS. 18 to 20 show other embodiments of the present invention; in which

FIG. 18 is a sectional perspective view showing a mixing element in which a fluid passage extending in the axial direction of the helical shaft of the mixing element shown in FIG. 2 is formed in an axial center portion thereof;

FIG. 19 is a sectional perspective view showing a mixing element in which a fluid passage extending in the axial direction of the helical shaft of the mixing element shown in FIG. 8 is formed in an axial portion thereof; and FIG. 20 is a longitudinal sectional view showing a central part of a mixer assembled by connecting the mixing elements shown in FIGS. 18 and 19;

DESCRIPTION OF THE PREFERRED EMBODIMENTS

Figure 1:
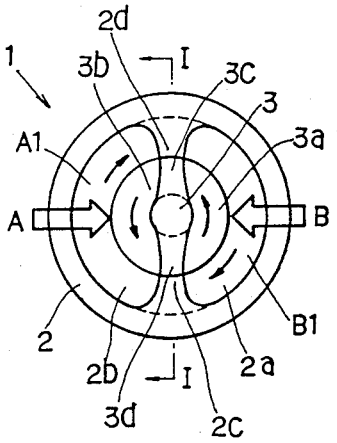

Embodiments of the present invention will hereinafter be described in detail in accordance with the attached drawings.

At first, FIG. 1 to 6 show an embodiment of mixing elements of the present invention which comprises a passage tube having a helical groove formed clockwise on its inner wall and a helical shaft having a helical groove formed counterclockwise thereon.

The description of FIGS. 1 to 6 will be hereinafter given together. A mixing element 1 is constituted by a cylindrical passage tube 2 having high wall thickness and, for example, made of a plastic, and a helical shaft 3 inserted in this passage tube 2 and, for example, made of a plastic.

Two helical grooves 2*a* and 2*b* are formed so as to rotate clockwise at 1 lead (360 degrees) on the inner peripheral wall of the passage tube 2 throughout its length through both ends thereof. The sections of grooves which are perpendicular to the helical direction are each in the form of a semicircle. Wide helical grooves 3*a* and 3*b* are further formed so as to rotate counterclockwise at 1 lead on the peripheral wall of the above-mentioned helical shaft 3 throughout its length through both ends thereof.

At this time, accompanied by the formation of the above helical grooves 2*a* and 2*b* and the helical shaft 3*a* and 3*b*, pairs of screw threads 2*c* and 2*d*, and 3*c* and 3*d* are formed on the inner peripheral wall of the passage tube 2 and on the outer peripheral wall of the helical shaft 3 respectively.

It is preferable that an inside diameter of the screw thread 2*c* or 2*d* of the passage tube 2 is comparable to an outside diameter of the screw thread 3*c* or 3*d* of the helical shaft 3 so that the helical shaft 3 is freely insertable in the passage tube 2, namely "clearance fit", "rest fit", or "interference fit" is applied.

It is further preferable that a cross-sectional area of a fluid passage formed in the passage tube 2, which is perpendicular to the longitudinal direction thereof, is usually constant throughout the length of the fluid mixing element of the present invention.

When this mixing element is used, for example, fluids A and B to be mixed are supplied to inlets A1 and B1 formed by the combination of the helical grooves 2*b*–3*b* and 2*a*–3*a*, respectively.

The fluid A supplied to the inlet A1 rotates as it flows through the mixing element, partly along the helical groove 2*b* formed in the passage tube 2 so as to rotate clockwise and partly along the helical groove 3b formed on the helical shaft 3 so as to rotate counterclockwise, to opposite directions, respectively.

On the other hand, the fluid B supplied to the inlet B1 rotates as it flows through the mixing element, partly along the helical groove 2*a* formed in the passage tube 2 so as to rotate clockwise and partly along the helical groove 3*a* formed on the helical shaft 3 so as to rotate counterclockwise, to opposite directions, respectively, as is the case with the above fluid A. That is to say, each of these fluids A and B has already been divided into two parts to form partial flows in the neighborhood of the inlets A1 and B1.

As this flowing proceeds, the partial flow of the fluid A which flows through the helical groove 2*b* of the passage tube 2 comes into cylindrical contact with the partial flow of the fluid B which flows through the helical groove 3*a* of the helical shaft 3, at their divided surfaces.

Similarly, the partial flow of the fluid A which flows through the helical groove 3*b* comes into cylindrical contact with the partial flow of the fluid B which flows through the helical groove 2*a*, at their divided surfaces.

At these contact surfaces, the turbulent flow is produced because of the different flow directions, and consequently the mixing action, the so-called turbulent mixing, occurs.

As the flowing further proceeds, each partial flow arrives at contact portions of the screw thread 2*c* of the passage tube 2 and the screw thread 3*d* of the helical shaft 3. At these portions, the contact turbulent mixing of each partial flow is once interrupted. As a result, the flow is regularly adjusted and the contact turbulent mixing to be subsequently achieved is enhanced.

In this embodiment which comprises two helical grooves 2*a* and 2*b* formed in the passage tube 2 and two helical grooves 3*a* and 3*b* formed on the helical shaft 3, the contact portions of the screw threads 2*c* and 2*d* and the screw threads 3*c* and 3*d* totally count eight, resulting in repetition of the contact turbulent mixing by the number thereof.

On the other hand, liquid has the property of being generally liable to flow through a portion of low resistance.

This tendency is also observed in the flowing of the fluids A and B through the mixing element of the present invention, and the fluids show the motion of flowing between the helical grooves 2*a* and 2*b* and the helical grooves 3a and 3b which helically cross at prescribed portions while alternately wandering. This motion of the fluids A and B brings about the effect that the above-mentioned contact turbulent mixing is promoted.

When the fluids A and B flow through the helical grooves 2*a* and 2*b* or 3*a* and 3*b* of the mixing element 1, the phase transfer is carried out at planes perpendicular to the flow by inertia of the fluids.

Accordingly, the fluids A and B are replaced with each other in series between the above cylindrical contact surfaces of the fluids A and B and portions where the fluids do not contact, and the partial flows of the fluids A and B are divided at the contact portions of the above screw threads 2*c* and 3*d* or 3*c* and 2*d*.

As the material of the passage tube 2 and the helical shaft 3 in the present invention, there can be used not only plastics such as polycarbonates, polyethylene, polypropylene, polyethylene terephthalate, polybutylene terephthalate, epoxy resins, acrylic resins, ABS resins, fluororesins and the like, but also metallic materials such as aluminium, stainless steel, iron, nickel, copper, titanium, and the like, or inorganic materials such as ceramics, carbon fibers and the like, further composite materials (for example, carbon fiber reinforced plastics) obtained by combining a plurality of these materials. In this case, a heat-resistant, wear-resistant or corrosion-resisitant coating may be applied on the surface of the plastic, metallic or inorganic mixing element.

The shape of the passage tube is not limited to a circular cylindrical form, but any shape can be employed so long as the helical groove can be formed on the inner wall thereof.

As the mixing element of the present invention, for example, these may be mentioned the element in which the plural helical shafts are inserted in the elongated passage tube, or the element in which the helical shaft is inserted in each of the plural elongated tubes bored through a block body from one surface to the other opposite surface thereof.

Also, with respect to the number of the helical grooves formed in the passage tube 2, and on the helical shaft 3, the suitable number of the grooves such as 1, 2, 3, 4 and so on can be selected according to the number of the fluids to be mixed and the properties thereof.

Further, the lead of the helical grooves 2*a* and 2*b* or 3*a* and 3*b* in one mixing element 1 is not limited to 1 in number, but any number of the lead may be employed.

Usually, the helical shaft 3 inserted in the passage tube 2 is held in the passage tube 2, for example, by fixing the passage tube 2 and the helical shaft 3, respectively, or by fixing the contact portions of the screw threads 2*c* and 2*d* and the screw threads 3*c* and 3*d* by means of welding or an adhesive. However, the helical shaft 3 may be rotatably inserted in the passage tube 2 without fixing.

Further, the screw threads of the passage tube 2 and the helical shaft 3 can be constituted by blades, or either of the passage tube 2 and the helical shaft 3 can be formed in blade shape.

In the present embodiment, since the helical grooves 2*a* and 2*b* and the helical grooves 3*a* and 3*b*, the rotational directions of which are different from each other, are combined, the points of intersection of the helical grooves 2*a*, 2*b*, 3*a* and 3*b* increase greater in number. Therefore, high efficient mixing of fluids can be achieved.

Next, FIGS. 7 to 12 show another embodiment of mixing elements of the present invention which comprises a passage tube having a helical groove formed counterclockwise on its inner peripheral wall and a helical shaft having a helical groove formed clockwise thereon.

In a mixing element 4 of the present embodiment shown in FIGS. 7 to 12, two helical grooves 5a and 5b are formed so as to rotate counterclockwise at 1 lead on an inner peripheral wall of a passage tube 5 and two helical grooves 6a and 6b are formed so as to rotate clockwise at 1 lead on an outer peripheral wall of a helical shaft 6. That is to say, in this mixing element, the rotational directions of the helical grooves are just opposite to those of the above embodiment shown in FIG. 1 to 6.

Also, in such a mixing element 4 of this embodiment, screw threads 5*c* and 5*d* are formed on the inner peripheral wall of the passage tube 5 by the formation of the helical grooves 5*a* and 5*b*, and screw threads 6*c* and 6*d* are formed on the outer peripheral wall of the helical shaft 6 by the formation of the helical grooves 6*a* and 6*b*, respectivley, as is the case with the mixing element 1 of the embodiment described above.

When fluid A and B to be mixed are supplied to an inlet A1 formed by the helical grooves 5*b* and 6*b* and an inlet B1 formed by the helical grooves 5*a* and 6*a*, respectivley, each of the fluids A and B is divided into two parts along the helical grooves 5*b*–6*b* and 5*a*–6*a* which rotate to opposite directions, respectively, to form partial flows in the neighborhood of the inlets A1 and B1, as is the case with the embodiment previously described.

As this flowing proceeds, the partial flow of the fluid A which flows through the helical groove 5b of the passage tube 5 comes into cylindrical contact with the partial flow of the fluid B which flows through the helical groove 6a of the helical shaft 6, at their divided surfaces.

Similarly, the partial flow of the fluid A which flows through the helical groove 6b comes into cylindrical contact with the partial flow of the fluid B which flows through the helical groove 5a, at their divided surfaces.

At these contact surfaces, the turbulent flow is produced because of the different flow directions, and consiquently the mixing action, the so-called turbulent mixing, occurs.

As the flowing further proceeds, each partial flow arrives at contact portions of the screw thread 5c of the passage tube 5 and the screw thread 6d of the helical shaft 6. At these portions, the contact turbulent mixing of each partial flow is once interrupted. As a result, the flow is regularly adjusted and the contact turbulent mixing to be subsequently achieved is enhanced.

In this embodiment which comprises two helical grooves 5a and 5b formed in the passage tube 5 and two helical grooves 6a and 6b formed on the helical shaft 6, the contact portions of the screw threads 5c and 5d and the screw threads 6c and 6d totally count eight, resulting in repetition of the contact turbulent mixing by the number thereof.

On the other hand, liquid has the property of being generally liable to flow through a portion of low resistance.

This tendency is also observed in the flowing of the fluids A and B through the mixing element of the present invention, and the fluids show the motion of flowing between the helical grooves 5a and 5b and the helical grooves 6a and 6b which helically cross at prescribed portions while alternately wandering. This motion of the fluids A and B brings about the effect that the above-mentioned contact turbulent mixing is promoted.

When the fluids A and B flow through the helical grooves 5a and 5b or 6a and 6b of the mixing element 4, the phase transfer is carried out at planes perpendicular to the flow by inertia of the fluids.

Accordingly, the fluids A and B are replaced with each other in series between the above cylindrical contact surfaces of the fluids A and B and portions where the fluids do not contact, and the partial flows of the fluids A and B are divided at the contact portions of the above screw threads 5c and 6d or 5d and 6c.

The present invention is not limited to the mixing elements as shown in FIGS. 1 to 6 and FIGS. 7 to 12, in which the rotational direction of the helical groove of the helical shaft is opposite to that of the passage tube, but may include the mixing element in which the rotational directions of both are identical with each other, namely both the rotational direction of the helical groove of the passage tube and the rotational direction of the helical grooves of the helical shaft are clockwise or counterclockwise.

However, in order to perform the dividing mixing, the turbulent mixing and the phase transfer mixing described above in high efficiency, the mixing elements as exemplified in FIG. 1 to 6 or FIGS. 7 to 12, in which the helical groove of the passage tube and the helical groove of the helical shaft are different from each other in their rotational directions, are preferred.

Although the mixing element thus constituted can be singly used as a mixer, the plural elements are usually connected for use. In this case, it is effective to use the mixing elements different from each other in their rotational directions in various combinations thereof.

Figure 13:
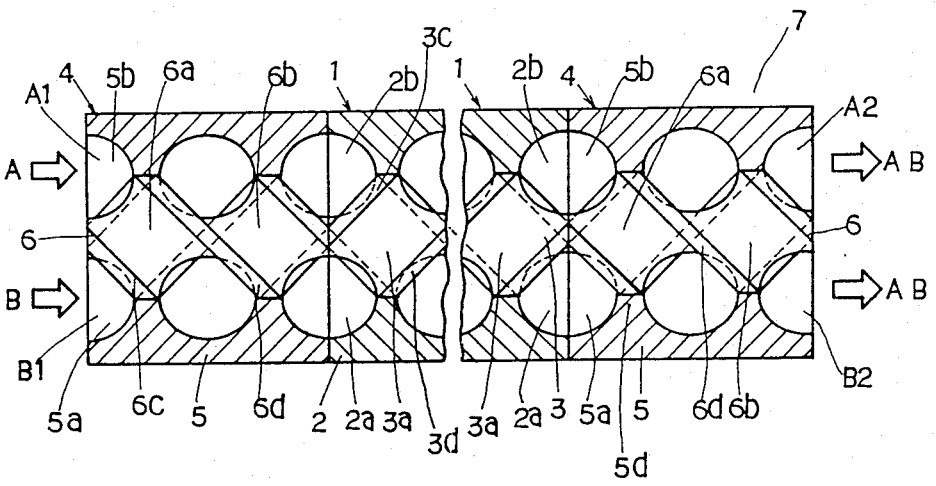

For example, FIG. 13 is a longitudinal sectional view showing a central part of a mixer 7 assembled by connecting the mixing elements according to the present invention. The mixer 7 comprises mixing elements 4 shown in FIG. 7 to 12 and mixing elements 1 shown in FIG. 1 to 6 which alternately connected to each other.

At this time, the mixing elements 1 and 4 are preferable to be connected so that the plane configurations at both ends of each of the mixing elements 1 and 4 overlap each other. However, the plane configuration of the mixing elements 1 and 4 can be allowed to overlap each other, displacing them at any angle in the range of 30 to 150 degrees.

When the mixing elements 1 and 4 are connected to each other, displacing the plane configurations at any angle, however, it is preferable to round off the peripheral edge of the inlet of the subsequent mixing element for reducing the resistance to the fluids A and B which arises at the peripheral edge of the inlet, or to insert between these mixing elements a spacer (not shown in the drawing) for introducing the flow of the fluids smoothly.

Upon the use of the mixer 7 thus constituted, when the fluids A and B are first supplied to the inlets A1 and B1 of the first mixing element 4, respectivley, each of the fluids A and B flows through the mixing element 4 along the counterclockwise helical grooves 5a and 5b formed in the passage tube 5 and the clockwise helical grooves 6a and 6b formed on the helical shaft 6, as described above.

Meanwhile, the phase transfer of the fluids is effected, and the contact turbulent mixing and the dividing mixing are repeatedly carried out at 8 contacted portions of the screw threads 5c and 5d of the passage tube 5 and the screw threads 6c and 6d of the helical shaft 6.

The fluids A and B thus mixed in the first mixing element 4 are introduced in the subsequent second mixing element 1 and flow through the mixing element 1 along the clockwise helical grooves 2a and 2b formed in the passage tube 2 and the counterclockwise helical grooves 3a and 3b formed on the helical shaft 3, as described above.

Meanwhile, the phase transfer on the liquids is effected, and the contact turbulent mixing and the dividing mixing are repeatedly carried out at 8 contact portions of the screw threads 2c and 2d of the passage tube 2 and the screw threads 3c and 3d of the screw shaft 3.

Similarly, the fluids A and B more finely mixed in the mixing element 1 are further repeatedly mixed in the third mixing element 4, the fourth mixing element 1 and so on in series. As a result, the mixed fluid AB thoroughly homogeneously mixed is allowed to effuse from outlets A2 and B2 of the mixer 7.

The mixing element used in the mixer 7 is not limited to the element in which the rotational directions of the helical grooves formed in the passage tube and on the helical shaft are different from each other as the mixing element 1 or 4 described above, but may include, for example, the element in which the rotational directions of both the grooves are identical with each other.

However, as the mixing element, it is generally preferable in terms of mixing efficiency to use the element in which the rotational directions of both the helical grooves are different from each other as described above.

The connecting methods of the mixing elements is not limited to the alternate connection of the mixing elements 1 and 4 in which the rotational directions are different from each other as the mixer shown in FIG. 13, but the mixing elements identical in their rotational direction can be connected (for example, the mixing elements 1 alone can be connected), or the plural mixing elements identical in their rotational direction and the plural mixing elements different therefrom in their rotational direction may be connected in the block, respectively.

However, the mixer assembled by connecting the mixing elements in which the rotational directions are different from each other (for example, the mixing elements 1 and 4) alternately one by one is preferable in terms of mixing efficiency.

Figure 14:
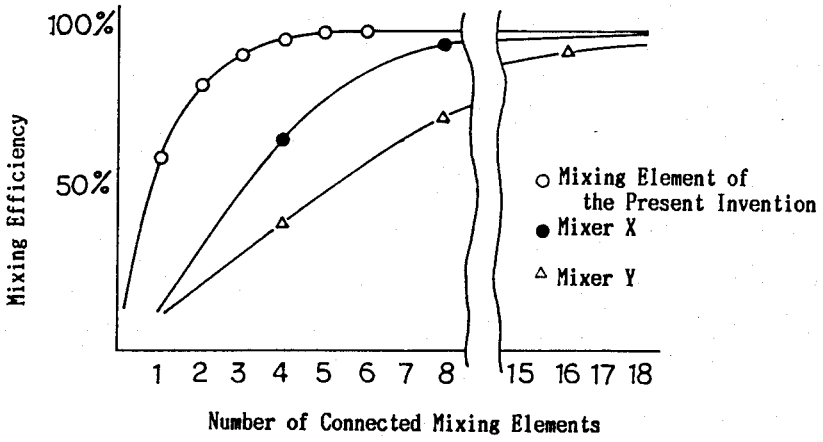
Figure 24:
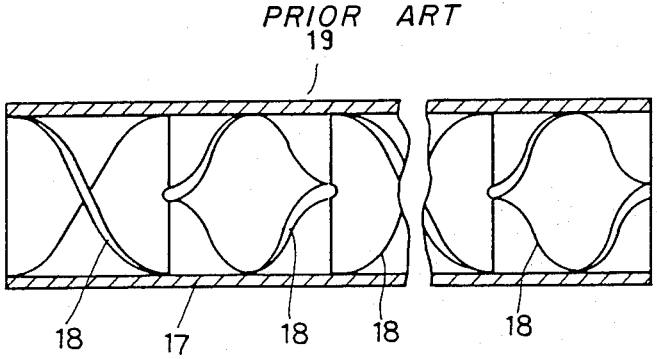
FIG. 24 PRIOR ART
FIG. 24 is a sectional view of a central part taken along line V—V of FIG. 22.
Figure 25:
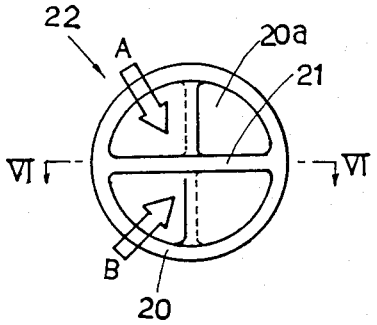
FIG. 25 PRIOR ART
FIG. 25 is a plane view of a conventional mixing element in which short helical blades twisted at an angle of 90 degrees are formed in a shaft cylindrical passage tube so as to be integral therewith.
Figure 26:
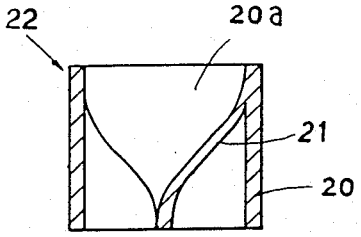
FIG. 26 PRIOR ART
FIG. 26 is a sectional view taken along line VI—VI of FIG. 25.
Figure 27:
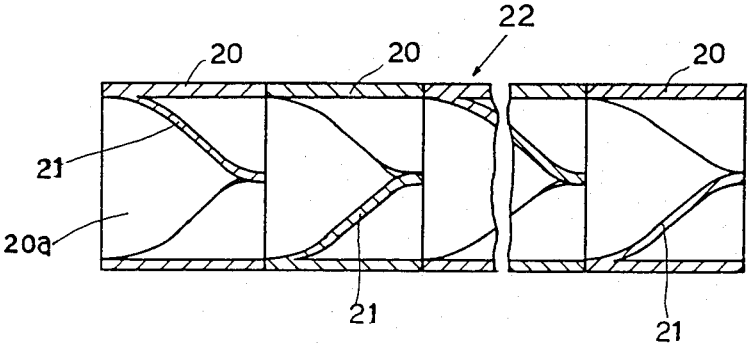
FIG. 27 PRIOR ART
FIG. 27 is a longitudinal sectional view showing central part of a mixer assembled by connecting these mixing elements.
Figure 28:
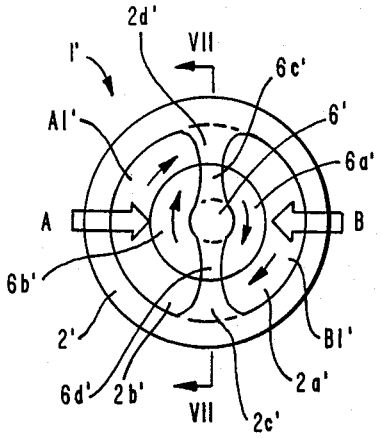
Figure 29:
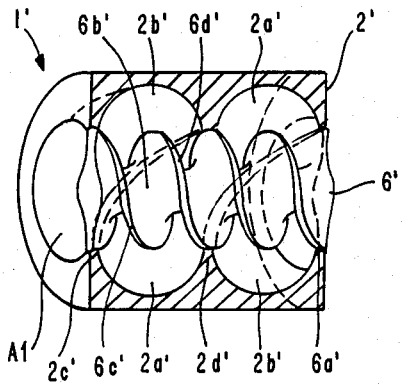
Figure 30:
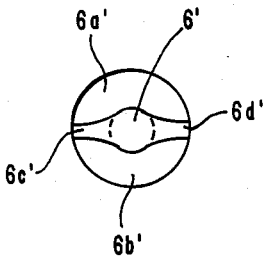
Figure 31:
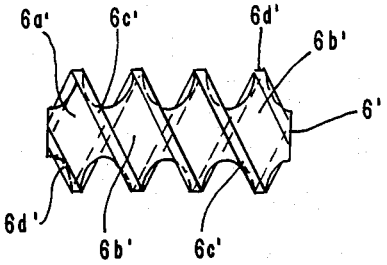

FIG. 14 is a graph showing the relation between "the mixing efficiency and the number of the connected mixing elements", as a measure of the mixing efficiency for the mixer 7 constituted by the mixing elements of the present invention as shown in FIG. 13 and the conventional mixers X and Y shown in FIGS. 24 and 27 previously described, wherein, in the case of the mixer X shown in FIG. 24, the number of the blades 18 is regarded as the number of the connected mixing elements.

According to FIG. 14, in the case of the mixer 7 constituted by the mixing elements of the present invention, a mixing efficiency close to 100% is obtained by the connection of 4 to 6 mixing elements. As compared with this, it is understandable that more than 6 to 8 mixing elements are required to be connected for the mixer X shown in Fig. 24, and 12 to 24 mixing elements are required to be connected for the mixer Y shown in FIG. 27.

Moreover, when special fluids are mixed, about twice as many mixing elements as the connected mixing elements shown in FIG. 14 by number are required to be assembled.

That is to say, the approximately same mixing efficiency as that of the conventional mixing elements can be obtained by using the connected mixing elements of the present invention which number is one half to one fourth the number of the conventional mixing elements.

Next, another embodiment of the present invention will hereinafter be described in accordance with FIGS. 15 to 17.

Figure 2:
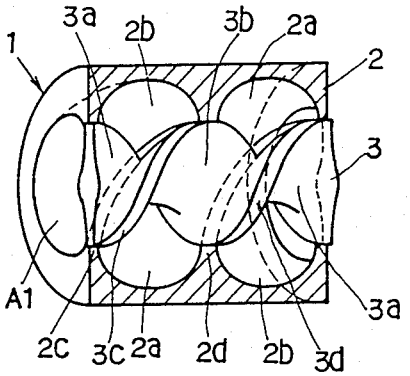
Figure 3:
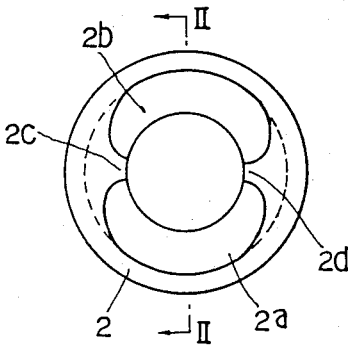
Figure 4:
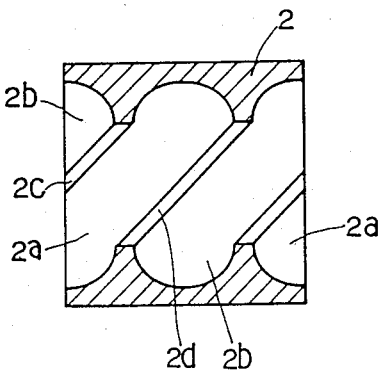
Figure 5:
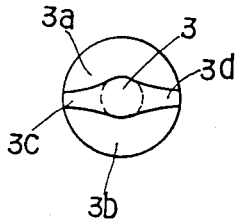
Figure 6:
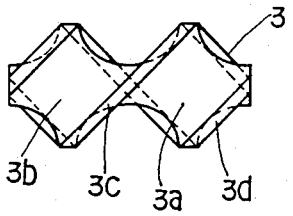
Figure 7:
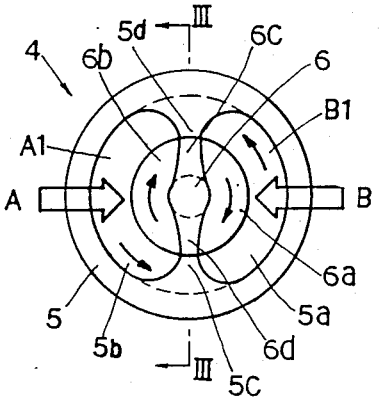
Figure 15:
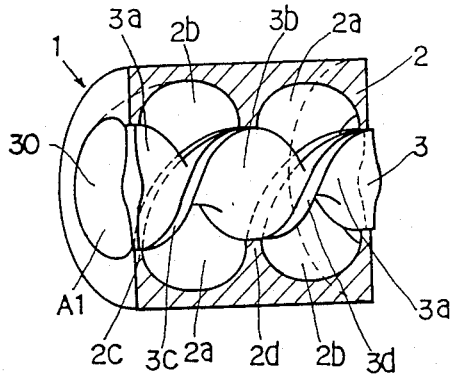

A mixing element 1 shown in FIG. 15 is constituted in such a manner that a passage tube 2 is gradually decreased in its inner diameter in the flowing direction of the fluid and a helical shaft 3 inserted in the passage tube 2 is gradually decreased in its outer diameter in the flowing direction of the fluid, with the exception of the mixing element shown in FIG. 2.

Thus, the mixing element 1 is formed in such a manner that a fluid passage 30 is gradually decreased in its crosssectional area in the flowing direction of the fluid.

Accordingly, even if the fluid passage 30 is liable to cause clogging by rapid gelation of the fluids A and B generated in the fluid passage 30, for example, the clogging of the fluid passage 30 caused by the gelation of the fluids A and B can be avoided without elevation of the pressure of the fluids A and B supplied through the inlets A1 and B1.

That is to say, the cross-sectional area of the flow passage is gradually decreased while the fluid pressure in the fluid passage 30 is constant, because the fluid passage 30 is formed in the shape described above. Therefore, the fluid pressure to the difinite cross-sectional area of the flow passage is increased, and hence the flow rate of the fluids A and B is gradually increased. Accordingly, the fluids A and B are pushed out from the outlets before the clogging of the fluid passage 30 takes place, even if the gelation of the fluids A and B begin to occur in the fluid passage 30. The clogging of the fluid passage 30 caused by the fluids A and B is thus avoided.

Figure 8:
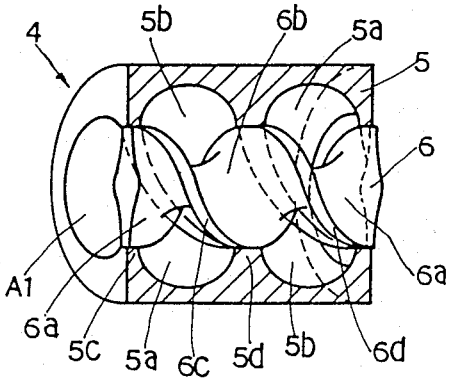
Figure 9:
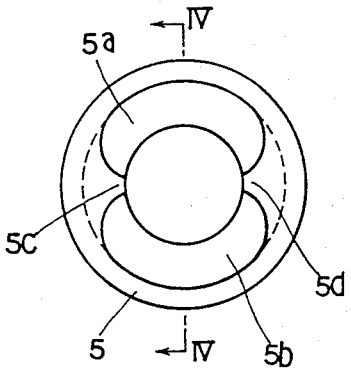
Figure 10:
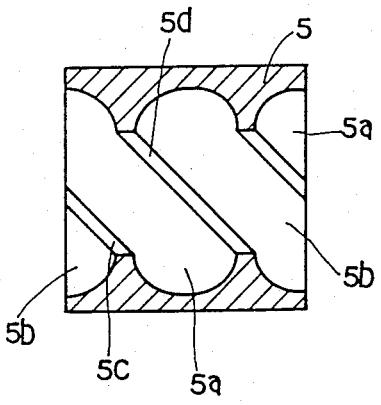
Figure 11:
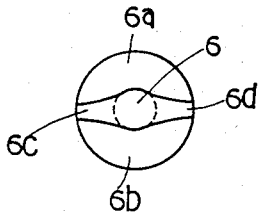
Figure 12:
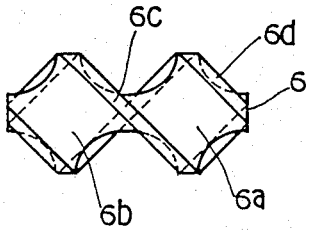
Figure 16:
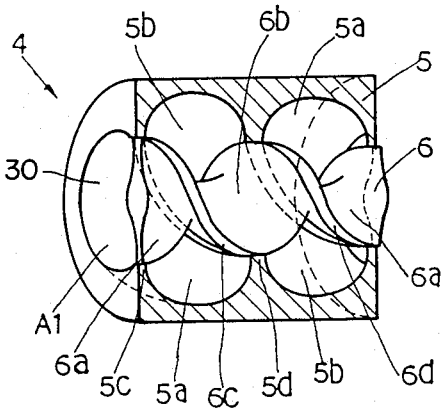

A mixing element 4 shown in FIG. 16 has the same structure and function as those of the fluid mixing element 1 shown in FIG. 15, with the exception that the mixing element shown in FIG. 8 is modified in such a manner that a passage tube 5 is gradually decreased in its inner diameter with advancing in the flowing direction of the fluid and a shaft 6 inserted in the passage tube 5 is gradually decreased in its outer diameter with advancing in the flowing direction of the fluids.

Figure 17:
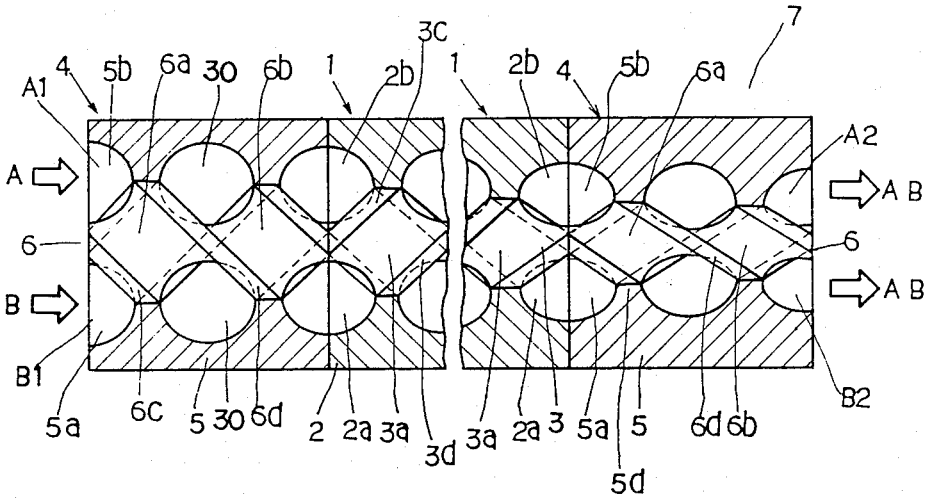

FIG. 17 further shows a mixer 7 assembled by connecting the fluid mixing elements 1 and 4 each shown in FIG. 15 and FIG. 16 alternately to each other.

The fluids passages 30 of the mixing elements 1 and 4 are formed in such a manner that the cross-sectional area of the flow passage is gradually decreased throughout the length of the mixer 7 in the flowing direction of the flulid, as described above. Consequently, the flow rate of the fluids A and B is increased with the progress of the gelation thereof, even if the mixing of the fluids A and B proceeds to cause the gelation thereof to take place in the fluid passage 30. Therefore, according to this mixer 7, the clogging of the fluid passage 30 caused by the gelation of the fluids A and B can be avoided.

This mixer 7 can be assembled so that the mixing element positioned on the most outlet side alone is composed of the mixing element 1 or 4 of the present invention in which the fluid passage 30 is gradually decreased in its cross-sectional area of the flow passage in the flowing direction of the fluid and the other mixing elements are composed of the mixing elements of the present invention in which the fluid passage is constant in its cross-sectional area of the flow passage throuthout its length.

The mixing element 1 or 4 employed in this mixer 7 can be decreased in its cross-sectional area of the flow passage in the flowing direction stepwise.

Further, another embodiment of the present invention will be hereinafter be described in accordance with FIGS. 18 to 20.

Figure 18:
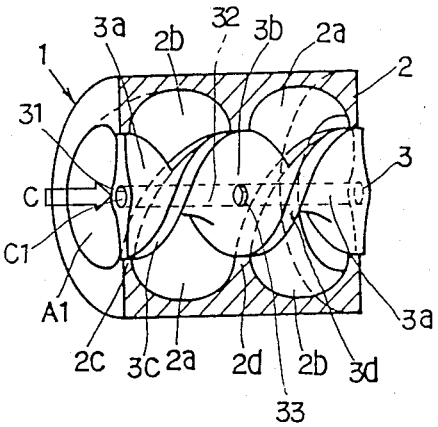

With respect to a mixing element 1 shown in FIG. 18, an axial center fluid passage 32 is formed in an axial center portion 31 of helical shaft 3 of the mixing element shown in FIG. 2 through both ends thereof, and a pair of branch openings 33 communicated with the axial center fluid passage 32 are formed on the peripheral side surface of this helical shaft 3, at the central part in the axial direction thereof.

According to this mixing element 1, a fluid C supplied through an inlet C1 into the axial center fluid passage 32 of the helical shaft 3 flows to the branch openings 33 formed at the central part in the axial direction of this helical shaft 3, as it is, and is here divided into a main flow running to an outlet through the axial central fluid passage 32 and a partial flow running in the branch openings 33.

After passing through the branch openings 33, the partial flow running in the branch openings 33 is allowed to effuse in the passage formed by the helical grooves 2a and 2b of the passage tube 2 and the helical grooves 3a and 3b of the helical shaft 3 wherein the contact turbulent mixing of the fluids A and B is being carried out.

In the course from here to the outlet of the mixing element 1, the contact turbulent mixing of the fluid C is also repeated, together with the fluid A and B.

In the fluid mixing element 1 shown in FIG. 18, the inlet C1 for the axial fluid passage 32 of the helical shaft 3 is not necessarily formed at the end face of the helical shaft 3. For example, it may be formed at the peripheral surface of the helical shaft 3. The axial center fluid passage 32 and the branch openings 33 may be formed in any shape and in any number. Further, the positions where the branch openings are formed are not particularly limited, so far as they are on the peripheral surface of the helical shaft 3.

This fluid mixing element 1 comprises the axial center fluid passage 32 formed in the axial center portion 31 of the helical shaft 3 and extending in the axial direction thereof.

Therefore, if the fluid C causes a rapid chemical reaction when mixed with the fluids A and B, for example, a danger that the mixing element 1 is damaged by the rapid chemical reaction caused in the mixing element is decreased by retarding the mixing time of the fluid C with the fluid A and B when they are supplied into the mixing element 1.

Further, a third component can also be added through this axial fluid passage 32.

Since the branch openings 33 are formed on the peripheral side surface of the helical shaft 3, in this embodiment, the fluid C corresponding to a diameter of the branch openings 33 in amount can be mixed with the other fluids A and B, at the retarded mixing time.

Figure 19:
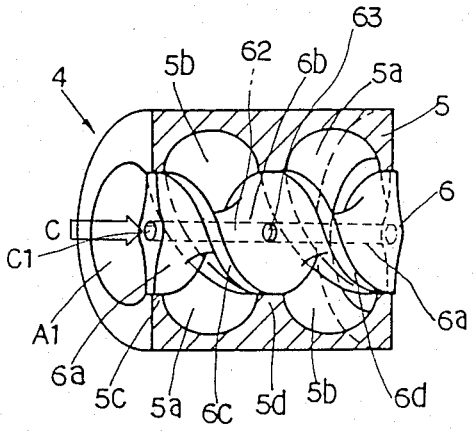

A mixing element 4 shown in FIG. 19 has the same structure and function as those of the fluid mixing element 1 shown in FIG. 18 described above, with the exception that a pair of branch openings 63 communicated with an axial center fluid passage 62 are formed on the peripheral side surface of the helical shaft 6 shown in FIG. 8, at the central part in the flowing direction thereof.

Figure 20:
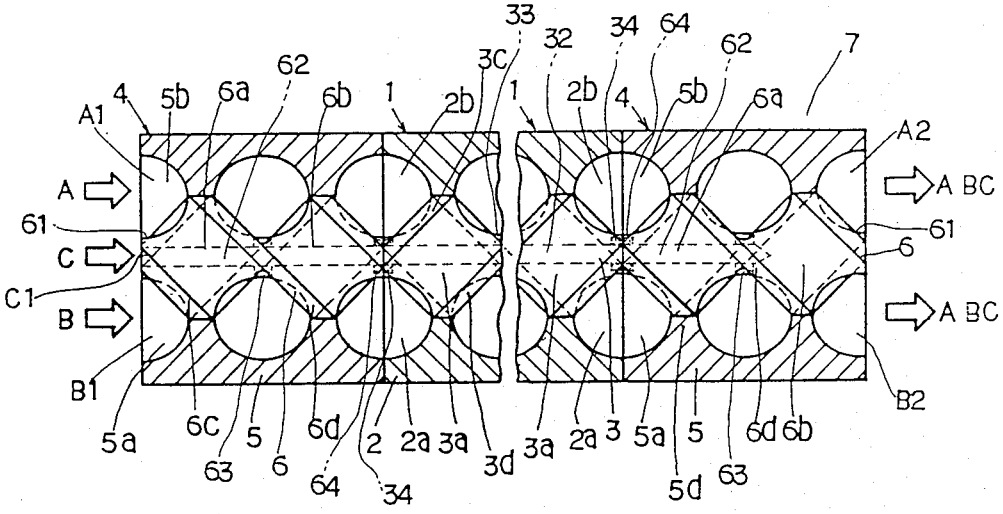

FIG. 20 further shows a mixer assembled by connecting the fluid mixing elements each shown in FIG. 18 and FIG. 19 alternately to each other, wherein the axial center fluid passage 62 of the mixing element 4 on the most outlet side of the mixer 7 is closed downstream from the position where the branch openings 63 are formed toward the flowing direction, and packings 34 and 64 are preventing the fluid C from leaking through a clearance between the axial center fluid passage 32 and 62 are mounted between the mixing elements 1 and 4.

Figure 21:
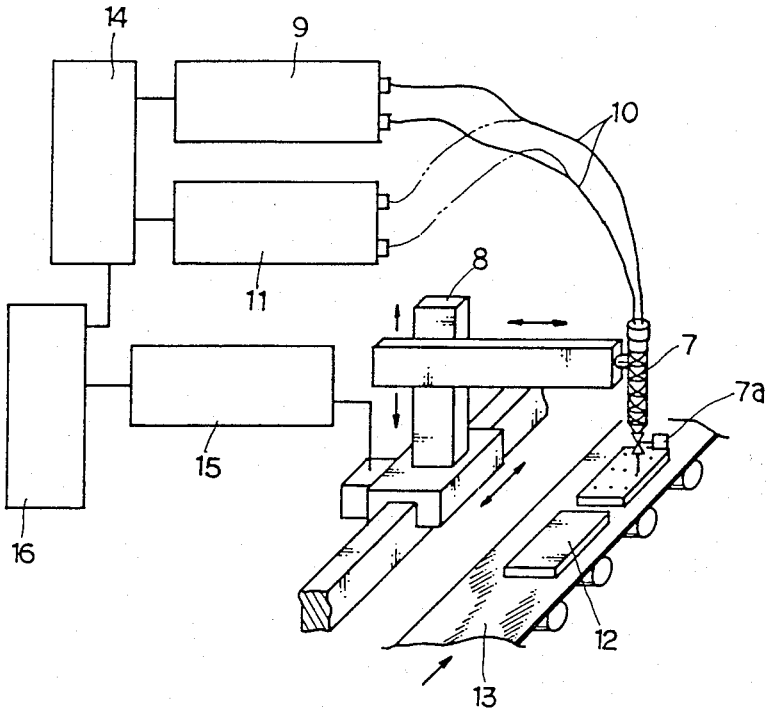
FIG. 21 is a schematic view showing a two-liquid mixing and delivering apparatus for resin type adhesives, in which there is utilized a mixer 7 (see FIG. 13) formed by alternately connecting the mixing elements 4 and 1 of the present invention in series.
Figure 22:
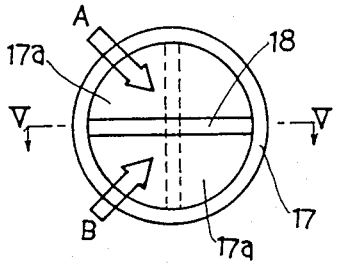
FIG. 22 PRIOR ART
FIG. 22 is a plan view of a conventional mixer in which short helical blades twisted at an angle of 180 degrees are arranged with angular displacement of 90 degrees in an elongated cylindrical passage tube.
Figure 23:
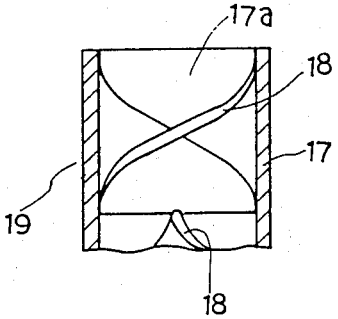
FIG. 23 PRIOR ART
FIG. 23 is a partially sectional view taken along line V—V of FIG. 22.

FIG. 21 is a schematic view showing a two-liquid mixing and delivering apparatus for resin type adhesives, in which there is utilized the mixer 7 (see FIG. 13) formed by alternately connecting the mixing elements 4 and 1 of the present invention in series.

The two-liquid mixing and delivering apparatus comprises a moving robot 8 constituting a working part, a mixer 7 mounted on an arm end of the robot 8 and having a delivery valve 7a, a pump unit 9 for storing a main agent A and a hardening agent B and forcedly supplying the fluid A and B to the mixer 7, flexible tubes 10 connecting the pump unit 9 with the mixer 7, a washing unit 11 for washing the inside of the mixer 7, a belt conveyor 13 for transferring a work 12, and a control part for controlling them.

The control part consisits of a mixer controller 14 for controlling the pump unit 9 and the washing unit 12, a robot controller 15 for controlling the robot 8, and a main controller 16 for controlling together both these controllers.

The pump unit 9 described above can be arbitrarily selected from a plunger pump, a gear pump, a screw pump, a tubing pump and the like, so as to be suitable for its use.

In such an apparatus, the arm of the robot 8 moves to a prescribed position by a command of the robot controller 15, and the main agent A and the hardening agent B are supplied from the pump unit 9 into the mixer 7 mounted on the arm end of the robot through the flexible tube 10 by a command of the mixer controller 14.

Both fluid agents supplied into the mixer 7 are completely mixed in the mixer, and the allowed to effuse on the surface of the work 12 by opening the delivery valve 7a.

On the interruption or the conclusion of operations, the flexible tube 10 is connected to the washing unit, and the fluid agents remaining in the mixer 7 are washed out.

In this apparatus, the mixer 7 assembled by connecting the mixing elements 1 and 4 of the present invention is employed in the two-liquid mixing and delivering apparatus for resin type adhesive. However, the use of the mixer is not limited to such an apparatus. The mixer can also be used in an apparatus for mixing, for example, the other liquids, gases or solids (powders, granules and the like) in the same phase or in different phases.

As the use of the mixing element of the present invention hereinabove described in detail, these are mentioned, for example, process in the resin and adhesive industries such as manufacture of a polymer, homogenization of a polymer, homogeneous dispersion of a pigment or a dye into a polymer, mixing of a plasticizer into a polymer, mixing of two fluid adhesives (for example, a general main agent-hardening agent mixing type adhesive), mixing of an adhesive of urethane resins (for example, one liquid bond type adhesive) and the like; processes in the textile industry such as manufacture of a polymer, polymer blending, homogenization of a polymer, mixing of an additive, emulsification of a textile assistant, heat exchange of a high viscosity polymer, chip blending and the like; processes in the chemical industry such as dilution of various chemicals (concentration adjustment of sodium hydroxide, ammonia or the like, pH adjustment of a chemical intermediate product and the like), mixing of various chemicals and the like; processes in the oil and fat industry such as saponification of fats and oils, neutralization of fats and oils, mixing and coloration of fats and oils and the like; processes in the food industry such as mixing of an oil and fat product, mixing and dissolution of a powder product, coloration and perfuming of a liquid or pasty intermediate product, manufacture of a foamy product (for exmaple, homogenization of a milk product, manufacture of a liking drink (for exmaple, blending in an alcoholic drink, a fruit juice drink, a cooling drink or the like), heat exchange and the like; process in the cosmetic industry such as mixing, coloration and perfuming of a liquid or pasty intermediate product (for exmaple, emulsification and perfuming of cream), emulsification of a liquid product (for example, addition of an additive to a hair dressing materail and mixing thereof) and the like; processes in the paper manufacturing industry such as mixing and homogenization of pulp, addition of an additive, addition of a coagulant to a waste solution and the like; process in the ceramic furnace industry such as mixing of raw materials (for example, mixing of ceramic or glass raw materials), washing and extraction of a raw material and the like; processes in the fuel industry such as mixing of fuel oil, emulsification of fuel oil, mixing of fuel gas and the like; processes in the metallurgy industry such as mixing of a powdery or granular raw material and the like; processes in the environment and wastewater treatment industry such as activation of sludge in a wastewater sludge tank, oxygen aeration in sludge, pH adjustment of wastewater, addition of a sludge coagulant and the like; processes in the transportation industry such as transportation of powders and granules; processes in the paint industry such as mixing of raw materials; preparation of a paint color, preparation of a quick-drying agent, preparation of a hardening agent and the like; processes in the civil engineering and construction industry such as kneading of concrete and the like; processes in the electric industry such as adhesion of electric parts (for example, adhesion of parts to a substrate), sealing of electric parts (for example, insulating sealing of a limit switch and the like), wiring of electric parts (for example, hot melt wiring on a substrate and the like) and the like; processes in the gas chemical industry such as mixing of special gases (for example, manufacture of anti-oxidation gas and manufacture of artificial air) and the like; and processes in the other fields such as oxygen supply to a pisciculture pond, manufacture of surrounding air for a biological laboratory, mixing operations in the correlated industries of the biotechnology and the like.

The mixing element of the present invention can thus be widely utilized in various fields of industry.

As described above, the mixing element of the present invention comprises the passage tube provided with at least one helical groove on the inner peripheral wall thereof, and at least one helical shaft provided with at least one helical groove on the outer peripheral wall thereof, said helical shaft being inserted in said passage tube.

Consequntly, the mixing element in which the suructure twisted at an angle of at least 90 degrees is formed can be easily manufactured, and the fluid mixing efficiency can be improved. The number of the mixing elements is therefore reducible, when a plural mixing elements are connected to each other to form the mixer, and the time required for mixing in the mixer is also reducible.

We claim:

1. A fluid mixing element comprising at least two segments arranged in fluid communication each segment comprising, a cylindrical passage tube provided with at least one helical groove, having a semicircular cross-section, on an inner peripheral wall of said passage tube throughout its length, and a helical shaft provided with at least one helical groove, having a semicircular cross-section, or an outer peripheral wall of said helical shaft throughout its length, said cylindrical passage tube having said helical shaft inserted therein, wherein in each segment the helical grooves of the passage tube and the helical shaft are formed in opposite directions, and wherein segments in communication with each other have helical grooves of the passage tube and helical grooves of the helical shaft respectively formed in opposite directions.

2. A fluid mixing element according to claim 1, wherein one to three helical grooves are formed on the inner peripheral wall of the passage tube and on the outer peripheral wall of the helical shaft, respectively.

3. A fluid mixing element according to claim 1, wherein the same number of the helical grooves are formed on the inner peripheral wall of the passage tube and on the outer peripheral wall of the helical shaft, respectively.

4. A fluid mixing element according to claim 1, wherein a cross-sectional area of a fluid passage of the passage tube perpendicular to the longitudinal direction of the passage tube is substantially constant throughout the length of the fluid mixing element.

5. A fluid mixing element according to claim 1, wherein the fluid passage formed by the helical groove of the passage tube and the helical groove of the helical shaft is constituted in such a manner that a cross-sectional area of the fluid passage is gradually decreased in the flowing direction of the fluid.

6. A fluid mixing element according to claim 1, wherein a fluid passage extending in the axial direction of the helical shaft is formed in a center portion thereof.

7. The fluid mixing element of claim 1 wherein said cylindrical passage tube and said helical shaft are comprised of a metallic material.

8. The fluid mixing element of claim 7 wherein said metallic material is stainless steel.

9. The fluid mixing element of claim 1 wherein said cylindrical passage tube and said helical shaft are comprised of a ceramic material.

10. The fluid mixing element of claim 1 wherein said cylindrical passage tube and said helical shaft are comprised of a plastic.

11. The fluid mixing element of claim 10 wherein said plastic is a polycarbonate.

12. The fluid mixing element of claim 10 wherein said plastic is a reinforced composite material.

13. The fluid mixing element of claim 12 wherein said plastic is reinforced with carbon fibers.

* * * * *